United States Patent [19]

Asamura et al.

[11] 3,947,294

[45] Mar. 30, 1976

[54] METHOD FOR TEMPER ROLLING OF A THIN-GAUGE STEEL STRIP

[75] Inventors: Takashi Asamura; Shigeki Sawai; Keisuke Sakamoto; Hajime Ikeda; Tohoru Toshimitsu, all of Kitakyusyu, Japan

[73] Assignee: Nippon Steel Corporation, Tokyo, Japan

[22] Filed: Feb. 6, 1975

[21] Appl. No.: 547,745

[30] Foreign Application Priority Data

Feb. 9, 1974 Japan ..... 49-16704

[52] U.S. Cl. ..... 148/12 C; 72/41; 148/12 D

[51] Int. Cl.[2] ..... C21D 9/46

[58] Field of Search ..... 148/12 D, 12 C, 12 R; 72/41

[56] References Cited

UNITED STATES PATENTS

| | | | |
|---|---|---|---|
| 2,606,848 | 8/1952 | Farling et al. | 148/12 D |
| 3,537,913 | 11/1970 | Klisowski | 148/12 C |
| 3,806,376 | 4/1974 | Toda et al. | 148/12 C |

OTHER PUBLICATIONS

Davies, P. W. et al.; Combined Quench Ageing–Strain Ageing Treatments; Special Report No. 79, The Iron and Steel Institute London; pp. 119–127; 1963.

*Primary Examiner*—W. Stallard

*Attorney, Agent, or Firm*—Wenderoth, Lind & Ponack

[57] ABSTRACT

A method for temper rolling of a thin-gauge steel strip comprising applying mechanical working to the steel strip under dry condition and then rolling the steel strip with lubricant between the rolling roll and the steel sheet.

4 Claims, 8 Drawing Figures

METHOD FOR TEMPER ROLLING OF A THIN-GAUGE STEEL STRIP

The present invention relates to temper rolling of a thin steel strip.

Steel strip such as thin cold rolled steel strip and substrates for tin-plate are ordinarily produced by acid-pickling and cold rolling a hot rolled steel strip obtained by hot rolling steel ingots or cast steel slabs. However, under the as cold-rolled condition, the grains are in the form of elongated fibrous structure, which is hard and has less workability. Therefore, so-called annealing is done by heating the steel to a temperature not lower than the recrystallization temperature so as to normallize the metal structure and releave the strain.

On the other hand, the annealed steel strip has yield point elongation phenomenon and is susceptible to stretcher strains and fluting during workings, and has poor surface luster and flatness. In order to avoid these defects and to improve workability, light cold working, namely temper rolling is done.

As for the temper rolling, particularly temper rolling of thin-gauge steel strip such as substrates for tin-plates (including substrates for tin-free steels and the substrate for tin-plate used hereinafter will have this meaning) which are to have a high degree of hardness in spite of their thin thickness, the rolling is conventionally done by a rolling mill of four-high, two-stand tandem type, and the rolling in this case conducted in completely dry state without using coolant for cooling the rolls, and lubricant for lubrication between the work rolls and the steel strip.

Therefore, metallic contact is caused between the work roll and the steel strip, and friction coefficient therebetween increases abnormally and reduction ratio in the temper rolling (inlet thickness - outlet thickness / outlet thickness) is limited to about 1.4% at highest, for example, when a thin-gauge strip heat treated by a continuous annealing furnace is rolled using a rolling mill having work rolls of about 584 mm diameter. Thus, it is very difficult to control mechanical properties of a thin-gauge steel strip in the temper rolling step, and particularly hardness in case of tin-plate substrates.

For obtaining desired mechanical properties of thin-gauge steel strip, it has been commonly practised to make adjustment of steel composition during the steel making step and adjustment of relation between temperature and time in the annealing treatment, and so that a certain limited working degree is maintained in the temper rolling step. Particularly in case of a hard material, as the adjustment of temperature - time relation in the annealing treatment has limitation in obtaining desired mechanical properties. The steel composition is controlled in order to increase hardness of the product. However, when the steel composition is controlled, deformation resistance of the steel strip during the cold rolling increases and load of the rolling mill is increased so that troubles will be caused against a high speed and stabilized operation.

Further, fine control of the steel composition in the steel-making step according to small orders by users requires close and precise scheduling, and increased addition of certain component elements will cause surface defects of the steel strip.

As above explained, if the limits in changing the mechanical properties of a thin-gauge steel strip by the temper rolling in dry state without using lubricant between the strip and the work roll are to be compensated by increased addition of certain steel component elements, control of relative amounts of steel component elements, and control of time - temperature relation in the annealing treatment after cold rolling, much loss of materials and great efforts will be required.

Further, as a problems which is caused inherently when the temper rolling is done in dry state, fine surface defects, so-called coil slips, are often caused due to vibration of a coiler and the steel strip when the strip is coiled on the coiler after temper rolling, and thus highspeed rolling operation is hindered. In order to avoid this problem, a coiler shaft of very high precision is required.

In order to eliminate the difficulties confronted with during the temper rolling in dry state without lubricant between the work rolls and the steel strip as above mentioned, it has been proposed to use rolling oil in the temper rolling as disclosed in "Tekko Binran" (Handbook of Steel), page 920, 2nd edition, published Oct. 5, 1962, Japan.

However, in case of so-called wet temper rolling using rolling oil between the work roll and the steel strip, there are following problems.

First, a problem of yield point elongation is seen in the mechanical properties of the steel strip as cold rolled and annealed (strip before temper rolling). The yield point lowers, as generally known, as the elongation increases to a certain point within a small elongation range during the temper rolling of the steel strip, and beyond the certain point the yield point rises as the elongation increases.

The above plastic behavior inherent to the thin-gauge steel sheet is particularly remarkable in case of a thin-gauge steel strip which has been subjected to continuous annealing treatment, and the yield point elongation, in particular, can be eliminated in dry temper rolling using dull rolls as work rolls, by giving about 0.4% elongation to a steel strip which has been treated by box annealing (strip is treated in its statistic coil state) and can be eliminated by giving about 1% elongation to a steel strip which has been treated by continuous annealing treatment. But in case of the wet temper rolling, more than 1% of yield point elongation remains even when more than 5% of elongation is given to the steel strip in the temper rolling in case the steel strip has been box-annealed and bright rolls are used as work rolls as seen in FIG. 1. This causes fluting during the can-making process.

On the other hand, when the dull roll is used as the work roll in the wet temper rolling, the yield point elongation can be improved to less than 1% by giving 1.3% elongation as shown in FIG. 2, but the yield point elongation phenomenon does not disappear giving only slight elongation as in the dry rolling.

Further, in case of a steel strip which has been subjected to continuous annealing, the yield point which lowers with the elongation rises back again to the point before the working when about 1% elongation is given and thereafter increases simply with the elongation in case of the dry rolling. But in case of the wet rolling, unless more than 5% of elongation is given, the yield point does not return to the original point.

For the above reasons when tin plate substrates, for example, are subjected to the wet temper rolling, yield point elongation remains while appropriate product hardness is obtained, so that problems such as stretcher strain and fluting are caused during forming by users.

Therefore, when the rolling is conducted by a four-high two-stand tandem type rolling mill applying rolling oil between the work rolls and the steel strip in both of the two stands, the elongation of the steel strip will change uncontinuously up to about 5% (herein called jumping phenomenon) with slight variation in the rolling pressure and the strip tension as shown in FIG. 3 and FIG. 4, due to the above mentioned two plastic behaviours of the steel strip, and thus necessitating gauge-change of the steel sheet. When the jumping phenomenon once takes place, adjustment of the elongation lower than the 5% is impossible and thus it is impossible to obtain continuously a desirable reduction rate.

The present invention has its object to eliminate the above mentioned defects in both the dry and wet rolling of a thin-gauge steel strip.

The feature of the present invention lies in a method of temper rolling a thin-gauze steel strip comprising subjecting a steel strip obtained by hot rolling cold rolling and annealing to mechanical working under dry condition first, and then rolling the steel strip using lubricant between the rolling roll and the steel strip.

The present invention will be described referring to the attached drawings.

The temper rolling method according to the present invention will be described in more detail hereinafter.

As mentioned before, by giving about 0.4 to 1.0% elongation to the steel strip in the temper rolling, or by passing the steel strip through a roller leveller under dry condition, or by passing the steel strip through a deflector roll with a tension within a certain range, so as to give mechanical working to the steel strip, the yield point elongation phenomenon disappears and the original yield point before the working is restored so that the jumping phenomemon can be avoided in the subsequent rolling operation.

Based on the above discoveries, it is necessary that the wet rolling is conducted only after mechanical working is given by dry pre-rolling or levelling.

Figure 5:
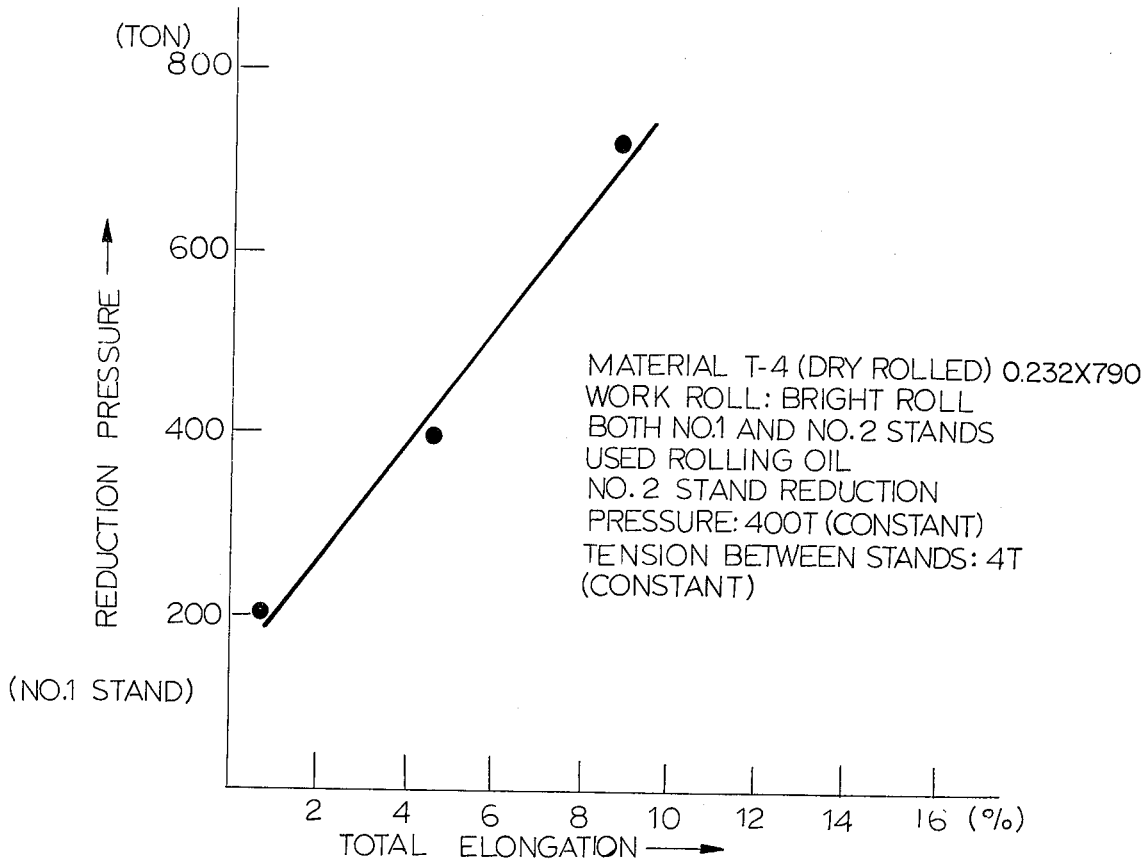
FIG. 5 shows results obtained by temper rolling the steel material under dry condition first, and then temper rolling the steel material under wet condition.

For example, the dry rolling may be conducted by rolling with a four-high two-stand tandem rolling mill to eliminate completely the yield point elongation and restoring the yield point to the level before the working or to a higher level, and then the wet rolling may be done in the same rolling mill with lubricant between the work roll and the steel strip. In case also no jumping phenomenon takes place, thus overcoming the jumping problem in the wet rolling. The relation between the rolling pressure and the elongation of the steel strip in this case is shown in FIG. 5.

Further, the jumping problem can be overcome also by passing the steel strip through a roller leveller under dry condition in other strip treating lines, or by giving some tension to the steel strip and giving deflection to the strip thus tensioned with such deflector rolls.

As above described, when mechanical working is given to the steel strip under dry condition and then temper rolling the steel strip under wet condition, namely using lubricant between the steel strip and the work roll, it is possible to give a large elongation to the steel strip, and hence it is possible to give the steel strip variation of mechanical properties in a wide range, so that the close and precise control such as increased addition of certain steel component elements and control of relative amounts of steel component elements during the steel-making process can be omitted, and in the annealing treatment after the cold rolling many heat-treatment patterns (temperature - time relation) which must confirm with final desired mechanical properties of the steel strip can be unified so that production efficiency is remarkably improved. However, in case when the dry pre-rolling is done in the temper rolling mill and the wet rolling in the same rolling mill, there is a defect that the production capacity of the temper rolling mill will be lowered to the half.

Also in case when levelling is effected to the steel strip in other production lines or when deflection is given to the steel strip under certain tension, it is often necessary that the treatment process is increased for giving the pre-mechanical working to the steel strip under dry condition.

Then, the present inventors have made further studies and have succeeded in effecting the above two-step treatments by only one rolling process without necessity of passing the steel strip twice through the temper rolling mill, or subjecting the strip to other processes for giving it the mechanical pre-working under dry condition. This success is based on the feature that the steel strip is first subjected to the dry rolling to eliminate the yield point elongation, and then the wet rolling is effected to give the steel strip wide variation of mechanical properties at this stage. For example, in case of a four-high two-stand tandem rolling mill, dry rolling is effected in No. 1 stand without lubricant between the work roll and the steel strip so as to eliminate the yield point elongation and restore the yield point to the level before the working or a higher level, and then wet rolling is done in No. 2 stand with lubricant between the work roll and the steel strip to give appropriate elongation to the strip in order to control the mechanical property variation in a wide range. Thus, dry rolling is done in the first stand of a temper rolling mill comprising a plurality of rolling stands, and wet rolling is done in the subsequent rolling stands.

Figure 1:
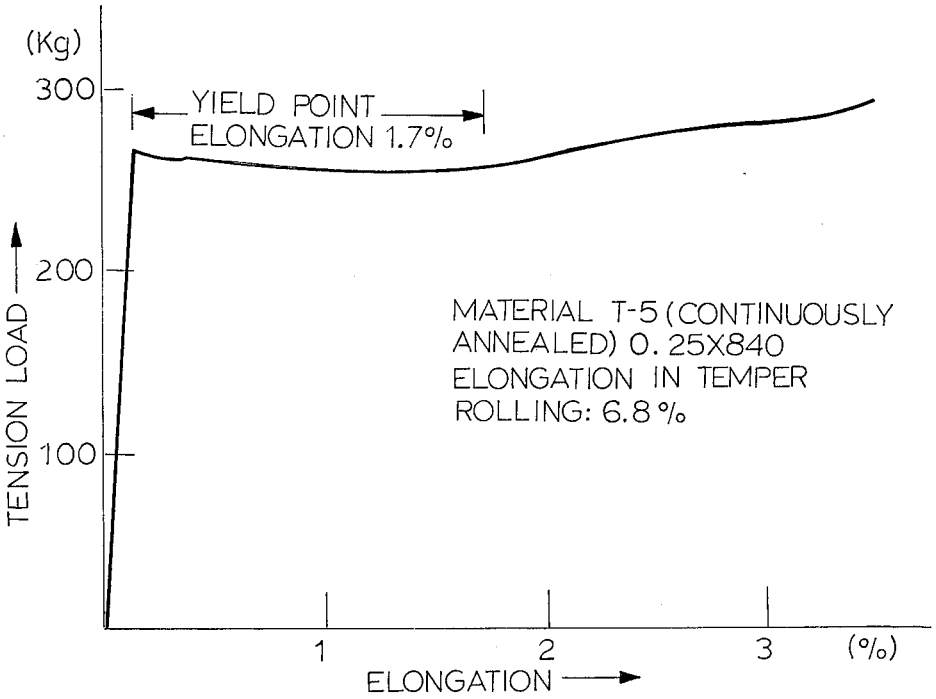
FIG. 1 shows results of tensile tests on the rolled materials in case when the wet rolling is done using bright rolls.
Figure 2:
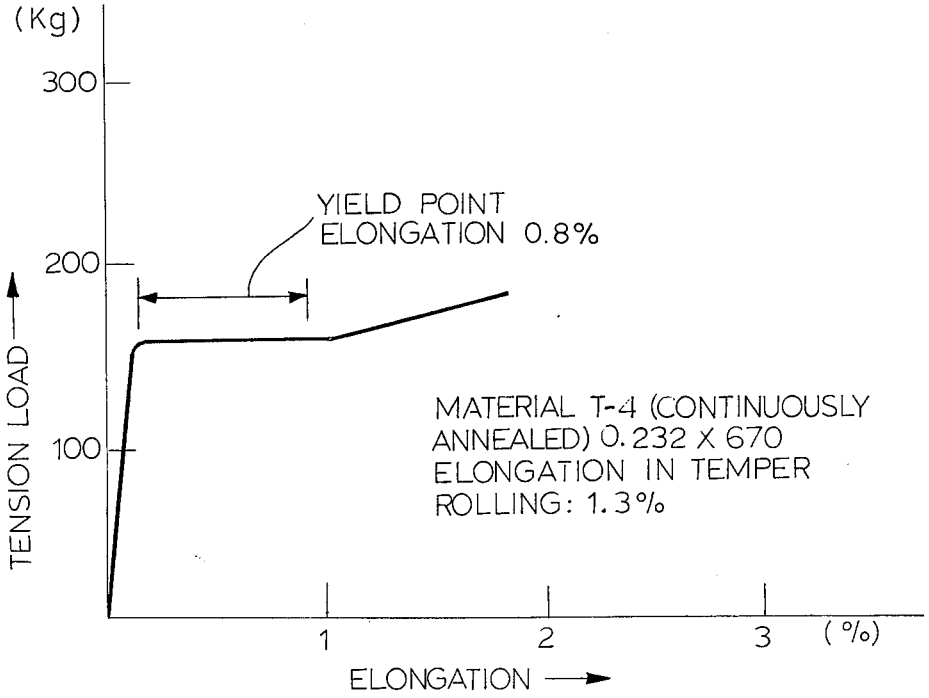
FIG. 2 shows similar results in case when the wet temper rolling is done using dull rolls.
Figure 3:
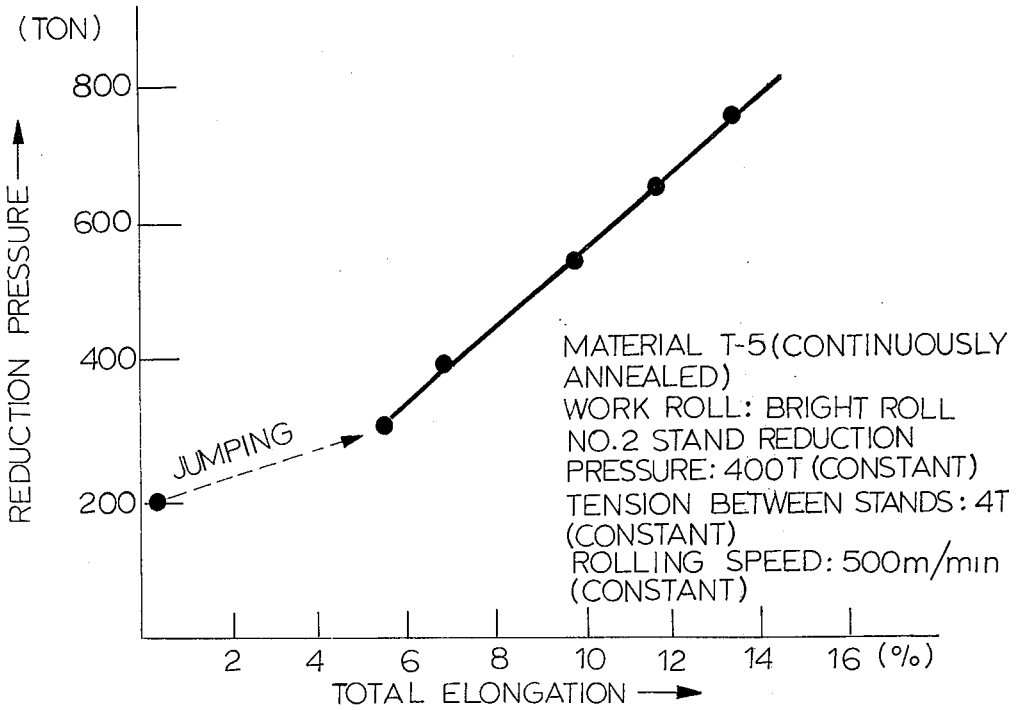
FIG. 3 shows results obtained the wet temper rolling using a four-high two-stand tandem rolling mill, in which the wet rolling was done in both No. 1 stand and No. 2 stand with bright rolls.
Figure 7:
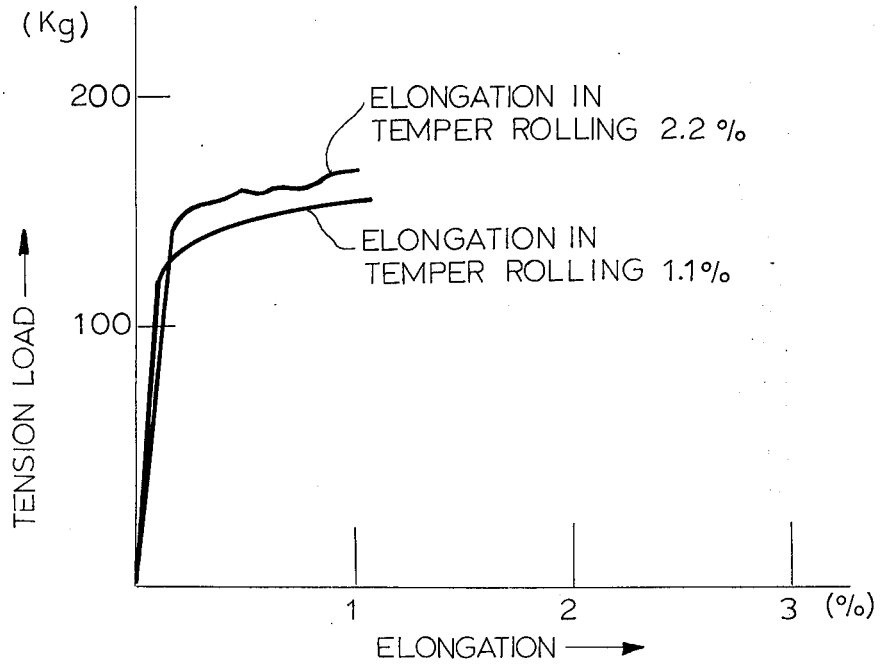
FIG. 7 shows results of tensile tests of the rolled materials which were temper rolled by the method and the apparatus shown in FIG. 6.
Figure 4:
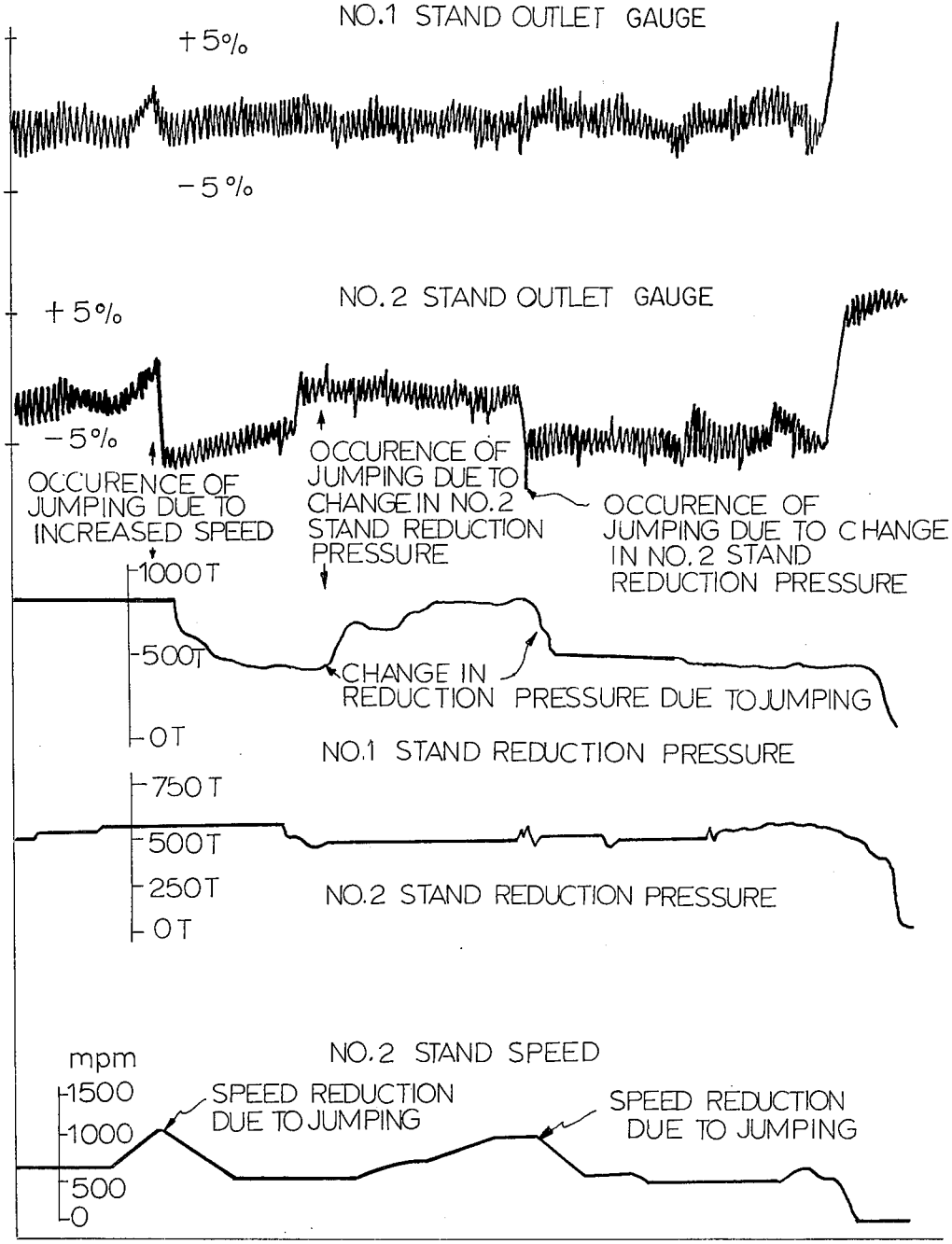
FIG. 4 shows results obtained by wet temper rolling using a four-high two-stand tandem rolling mill, in which the wet rolling was done in both No. 1 stand with dull rolls and No. 2 stand with bright rolls.
Figure 6:
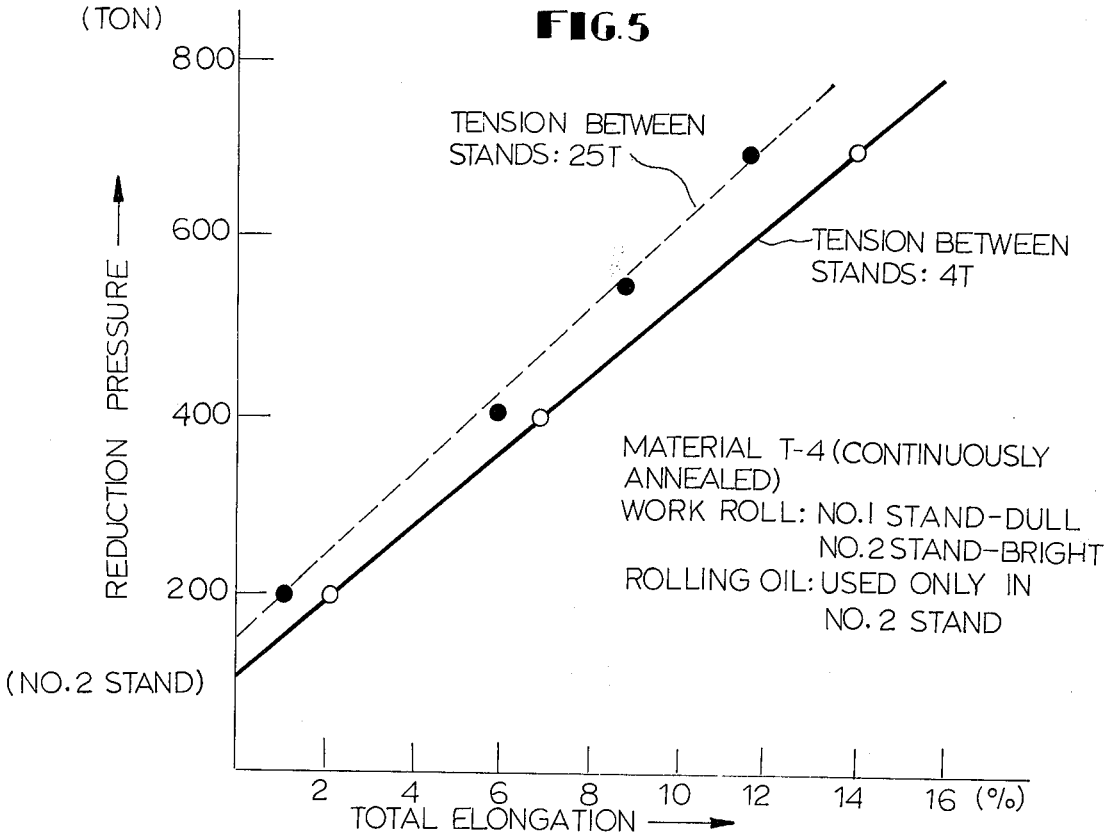
FIG. 6 shows results obtained by the temper rolling according to the present invention using a four-high two-stand tandem rolling mill.
Figure 8:
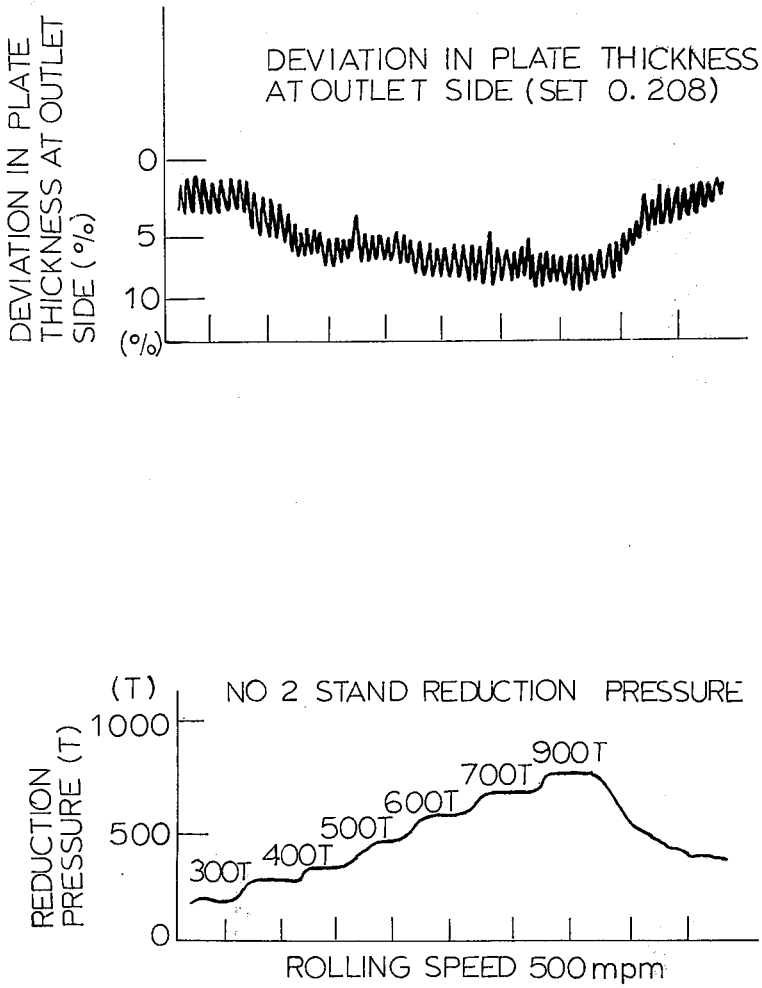
FIG. 8 shows effects of the rolling according to the present invention. According to the present invention, even when the reduction in No. 2 stand is varied stepwise, there appears no jumping phenomenon and deviation in the strip thickness on the outlet side varies in correspondence to the reduction, so that a desired elongation ranging from 0 to 10% is obtained continuously.

Results of the rolling in an actual rolling mill (four-high two-stand tandem type) according to the present invention are shown in FIG. 6, FIG. 7 and FIG. 8.

As clearly understood from the drawings, no jumping phenomenon was observed during the rolling and the rolling was possible with a desired elongation by adjustment of the reduction pressure in a wide range in No. 2 stand.

According to FIG. 8, in particular, even when the reduction in No. 2 stand is varied stepwise, there appears no jumping phenomenon and deviation in the strip thickness on the outlet side varies in correspondence to the reduction, so that a desired elongation ranging from 0 to 10% is obtained continuously.

In this case, even when the yield point elongation can not be eliminated completely and remains slightly, a desired elongation can be obtained and no problem such as stretch strain and fluting takes place so far as the remaining yield point elongation is such as can be eliminated within the elongation range applied to the steel strip in No. 2 stand.

As described above, according to the present invention, it is possible to control the mechanical properties of a steel strip, particularly tin-plate substrates in a wide range in the temper rolling step so that it is not necessary to increase addition of certain steel component elements during the steel-making step, thus resulting in the following advantages:

1. addition of hardening elements such as N is not necessary, thus lowering production cost;
2. close and precise schedule is not required in the steel-making step, thus rendering the production schedule much simpler;
3. interchangeability among ordered steel grades is increased, and steel grade pattern is simplified, thus lowering the production cost; and
4. deformation resistance of the steel material in the cold rolling can be lowered, thus reducing the rolling load and eliminating difficulties in a high-speed stabilized operation.

Further, the pattern of temperature - time relation in the annealing treatment can be unified, and particularly a batch annealing schedule is simplified, thus contributing largely to increase of the annealing capacity.

Thirdly, it is possible to produce all steel grades ranging from T-1 to T-6 hardness for tin-plate substrates from one steel material by the temper rolling, thus the steel materials and production process can be put in good order and productivity is improved largely.

Fourthly, as it is possible to prevent the coil strip damage inherent to the dry rolling in the temper rolling mill, it is not necessary to reduce the rolling speed in order to prevent the damage, and retreatment of the damaged steel strip is eliminated, so that the temper rolling can be done at high efficiency with stability.

What is claimed is:

1. A method of temper rolling a thin-gauge steel strip which is comprised in subjecting a steel strip obtained by hot rolling, cold rolling and annealing to mechanical working under dry condition and then rolling the steel strip using lubricant between the rolling roll and the steel strip.

2. A method according to claim 1, in which the mechanical working under dry condition is conducted in the first rolling stand of a two-stand tandem rolling mill without lubricant between the work roll and the steel strip to substantially eliminate yield point elongation of the steel strip and to raise yield point of the steel strip to a level before the working or a higher level, and then the rolling is done in the second rolling stand under wet condition using lubricant between the work roll and the steel strip to give the steel strip appropriate elongation so as to control changes in mechanical properties of the steel strip in a wide range.

3. A method according to claim 1, in which the mechanical working under dry condition is done by passing the steel strip through one or more roller levellers.

4. A method according to claim 1, in which the mechanical working under dry condition is done by giving the steel strip deflection under tension by means such as one or more deflector rolls.

* * * * *